US005129668A

United States Patent [19]

Hecht

[11] Patent Number: 5,129,668

[45] Date of Patent: Jul. 14, 1992

[54] SKI BOOT BINDING MOUNTING

[76] Inventor: Leonard Hecht, 7380-A Ostell Cresent, Montreal, Que., Canada, H4P 1Y8

[21] Appl. No.: 589,503

[22] Filed: Sep. 28, 1990

[51] Int. Cl.[5] ..... A63C 5/00

[52] U.S. Cl. ..... 280/607; 280/617; 280/618

[58] Field of Search ..... 280/617, 614, 14.2, 280/607, 601, 602, 610, 11.14, 11.15

[56] References Cited

U.S. PATENT DOCUMENTS

| | | | |
|---|---|---|---|
| 3,797,844 | 3/1974 | Smolka et al. | 280/617 |
| 4,696,487 | 9/1987 | Girard | 280/602 |
| 4,869,524 | 9/1989 | Bouque | 280/617 |
| 4,896,895 | 10/1990 | Bettosini | 280/607 |

FOREIGN PATENT DOCUMENTS

| | | |
|---|---|---|
| 750259 | 1/1967 | Canada . |
| 1230367 | 12/1987 | Canada . |
| 2838902 | 3/1980 | Fed. Rep. of Germany . |

OTHER PUBLICATIONS

Skis, p. 106 from "Skiing", Sep. 1990 issue.

Know Your Bindings: 20, pp. 98, 100, 172, 173, 174 and 177.

Know Your Bindings: 23, pp. 140, 141, 142, 144 from "Skiing" Nov. 1974.

*Primary Examiner*—Andres Kashnikow
*Assistant Examiner*—Richard Camby
*Attorney, Agent, or Firm*—Nixon & Vanderhye

[57] ABSTRACT

A ski boot binding mounting for mounting a ski boot binding to a ski comprises a base plate for supporting the ski boot binding, a first attachment for pivotally fixing a first longitudinal end of the base plate to the ski for allowing the first end to pivot about a lateral axis, and a second attachment for pivotally attaching a second longitudinal end of the base plate to the ski, the second attachment allowing the second end to pivot about the lateral axis and for allowing movement in a longitudinal direction of the ski while preventing any lateral movement of the base plate with respect to the ski. In this way, the ski may flex, while the base plate remains flat, assuring a constant position between the heel and toe binding elements. A solid feel of the snow is obtained, since the connection of the base plate to the ski is non-resilient.

11 Claims, 3 Drawing Sheets

SKI BOOT BINDING MOUNTING

FIELD OF THE INVENTION

The present invention relates to a ski boot binding mounting for mounting a ski boot binding to a ski. The present invention relates more particularly to a ski binding mounting for mounting ski boot bindings to a ski while allowing the ski to flex more freely.

BACKGROUND OF THE INVENTION

In a conventional ski binding, a toe piece and a heel piece are affixed directly to the ski. Mounting devices which connect ski boot bindings to skis for the purpose of providing shock absorption or greater ski flex are known in the art.

Canadian Patent 750,259 describes a resilient binding support having an upper arched member supported by two lower arched members such that the ski can flex longitudinally and laterally, and the arched members absorb the shocks of passing over rough terrain.

U.S. Pat. No. 4,896,895 describes a shock absorbing element for skis which acts as a mounting plate for the ski boot binding while dampening oscillations, vibrations and impacts during skiing. A shock absorbing layer of an elastomeric material supports the mounting plate on the ski in the middle, and the mounting plate is connected at its front and rear ends to the ski.

The prior art devices absorb shocks and allow the ski to flex more freely, however, the feeling of direct contact with the snow is lost having a suspension system between the boot and the ski, and the performance or ability of the ski boot bindings to release the ski boot is reduced as the surface to which the bindings are mounted flexes and the distance between the heel and toe bindings diminishes and the relative angle of the heel and toe binding components changes. Safety of the skier may be compromised if the bindings fail to release as desired.

SUMMARY OF THE INVENTION

It is therefore an object of the invention to provide a ski boot binding mounting which maintains the relative position of the heel and toe binding elements constant during flexion of the corresponding ski, while allowing the ski to flex uniformly unhindered by boot stiffness.

It is a further object of the invention to provide a ski boot binding mounting which distributes the weight of the skier substantially between two points, in front of center and behind center, to inhibit oscillations or chatter of the skis, thus allowing the skier to travel faster. The weight of the skier is used as the retention force against ski flexing.

According to the invention, a ski boot binding mounting for mounting a ski boot binding to a ski comprises a base plate for supporting the ski boot binding, the base plate having first and second longitudinal ends, first attachment means for pivotally fixing the first longitudinal end of the base plate to the ski for allowing this first end to pivot about a transversal axis, and second attachment means for pivotally attaching the second longitudinal end of the base plate to the ski for allowing the second end to pivot about another transversal axis, the second attachment means also allowing movement in a longitudinal direction of the ski while preventing any lateral movement of the base plate with respect to the ski.

In this way, the ski may flex, while the base plate remains flat, assuring a constant position between the heel and toe binding elements. A solid feel of the snow is obtained, since the connection of the base plate to the ski is non-resilient.

Preferably, the first end is at the front and the second end is at the rear, so that the moving of the second attachment means is felt at the heels instead of the toes.

Preferably also, the second attachment means comprise a link member having a lower rear end and an upper front end. The link member can then be pivotally connected at its lower rear end to the ski and at its upper front end to the base plate, such that the movement in the lengthwise direction is achieved by pivoting of the link member. The link member may preferably make an angle of at least 30 degrees with respect to the ski.

Alternatively, the second attachment means may preferably comprise a pin and track assembly.

Seal means for preventing entry of snow between the base plate and the ski are also preferably provided.

As can now be understood, the invention provides increased midbody torsional stiffness of the ski. The invention allows the use of softer skis at high speeds, and can enable a skier to carve smoother turns.

The base plate can also be widened and raised to support two ski boot bindings, if desired, for use with a uniski.

DETAILED DESCRIPTION OF THE PREFERRED EMBODIMENTS

Figure 9:
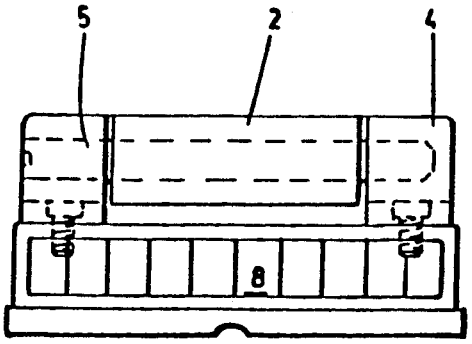
FIG. 9 is a break away front view of both preferred embodiments.

In the preferred embodiments shown in FIGS. 1 through 4, ski boot binding mounting 1 includes a base plate 2 to which rear ski boot binding 10 and front ski boot binding 11 are mounted. Base plate 2 is pivotally attached at its front end to ski 8 by means of pivot pin 5 and holder 4 (as also shown in FIG. 9). Base plate 2 is pivotally attached at the rear by rear attachment means 6 which allow the rear end of base plate 2 to pivot and move longitudinally. Rear attachment means 6 and holder 4 are securely fastened to ski 8 by means of screws 3.

Figure 1:
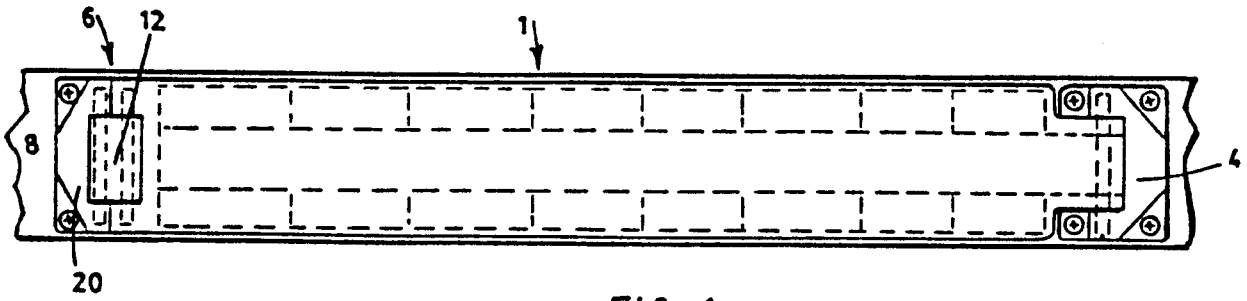
FIG. 1 is a top plan view of a first preferred embodiment.
Figure 2:
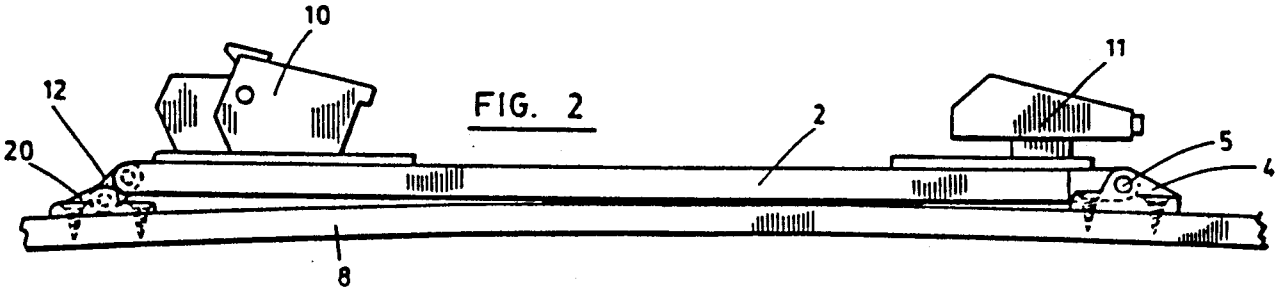
FIG. 2 is a side view of the first preferred embodiment of the invention in a natural position.
Figure 3:
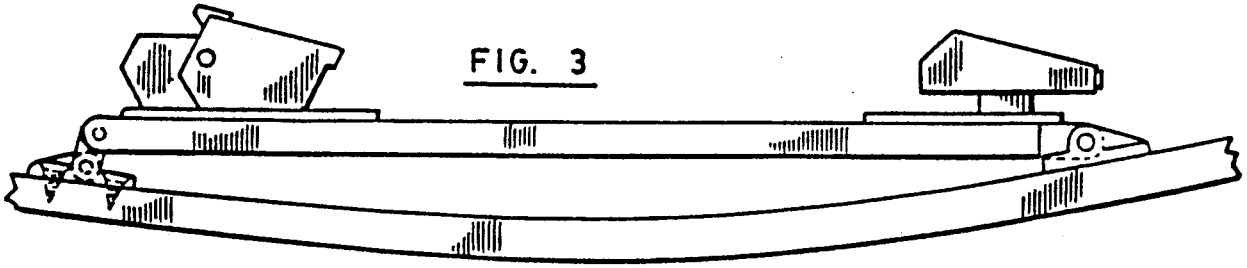
FIG. 3 is a side view of a first preferred embodiment of the invention in a flexed position.
Figure 8:
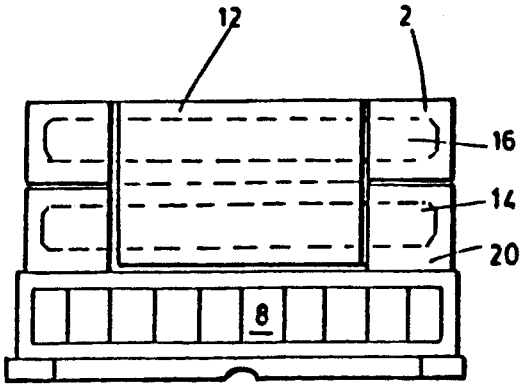
FIG. 8 is a break away rear view of the first preferred embodiment.

In the first preferred embodiment, as shown in FIGS. 1, 2, 3, and 8, the rear mounting means 6 comprise a link or shackle member 12 pivotally connected via a pin 14 to a holder 20 mounted to ski 8. Pin 14 floats in holder 20 and link member 12 turns on pin 14. Base plate 2 is provided with a pin 16 fixed thereto as shown in FIG. 8 such that link member 12 may turn about pin 16. As shown in FIGS. 2 and 3, the link member is at about 45 degrees with respect to the surface of ski 8 in its natural position and as ski 8 flexes as shown in FIG. 3, holder 20 is brought closer to holder 4 by the curvature of the ski 8 and link member 12 pivots opening the angle between itself and ski 8. The maximum flex position may bring link member 12 to make any angle between 90 and 135 degrees, depending on the length of the link member 12 chosen with respect to the length of base plate 2. Generally, link member 12 measures between 1.5 and 5.0 cm (about one half to two inches) in length between the centers of pins 14 and 16.

In this way, base plate 2 is securely mounted to ski 8, as ski 8 flexes while skiing over rugged terrain. However, the ski 8 is prevented from oscillating excessively or chattering by virtue of the length of the base plate 2 of about 20 inches (50 cm) which distributes the weight of the skier (not shown) between front pivot 5 and rear attachment means 6. The forward position of pivot 5 inhibits oscillation of the front part of ski 8, and the rearward position of attachment means 6 inhibit likewise the oscillation of the rear part of ski 8. As the ski 8 flexes, the base plate 2 remains unflexed, and therefore the relative positions of rear heel binding 10 and front toe binding 11 remain fixed preventing any adverse effects on binding performance (i.e. the ability of the bindings to release the boot) while negotiating rugged snow covered terrain. Due to the nature of attachment means 6 and 4, a feeling of control over ski 8 is maintained during flexing, since the mounting 1 can only move along one path during flexing and no sideways motion of the base plate 2 with respect to ski 8 can occur. Mounting 1 does not resist the flexing of ski 8 except by using the weight of the skier.

Figure 4:
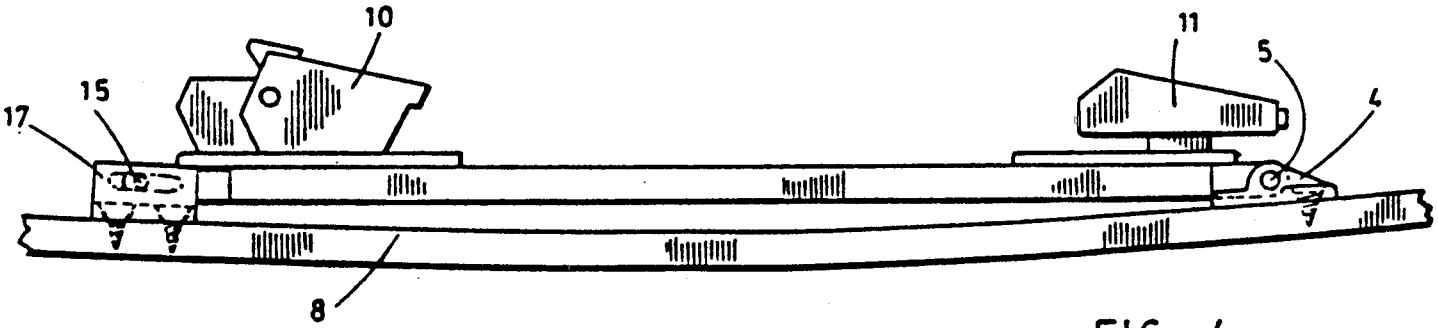
FIG. 4 is a side view of a second preferred embodiment of the invention.
Figure 10:
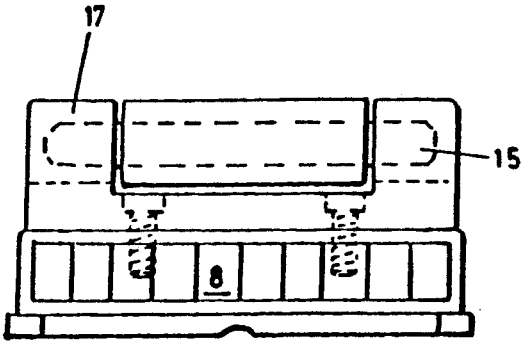
FIG. 10 is a break away rear view of the second preferred embodiment.

As shown in FIGS. 4 and 10, in the second preferred embodiment, the rear attachment means comprise a pin and track assembly, which includes a pin 15 slideable in a track member 17. Pin 15 is fixed to base plate 2, and allows the base plate 2 to be securely attached to the ski 8 while permitting a pivot and slide action necessary for ski flexing. The length of track member 17 is chosen in accordance with the length of base plate 2 and the flexibility of ski 8. In the natural position shown in FIG. 4, ski 8 is slightly arched, and therefore base plate 2 is supported in the natural position by holder 4 and track member 17 at about 0.5 cm above the surface of ski 8 at the ends and at about 0.1 cm at the middle of base plate 2 in the natural position.

Figure 7:
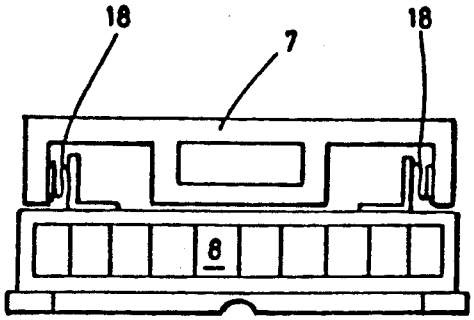
FIG. 7 is a cross sectional view of the preferred embodiments about the middle of FIG. 1.

As shown in FIG. 7, base plate 2 has a light weight high strength construction including a flat upper surface and a vertical rib structure for reinforcement. The rib structure is also shown in dotted lines in the plan view of FIG. 1. The transverse ribs shown in FIG. 1 are not shown in the section of FIG. 7. Base plate 2 can be extruded from aluminum or molded from any known suitable high strength, light weight material.

To prevent snow from entering under the base plate 2 and affecting the movement of the base plate 2 with respect to the ski 8, seal means are provided which include a rubber membrane 18 connected between inside side walls of base plate 2 and ski 8. The membrane 18 can be made of a thin synthetic rubber material such as that used in dental dam, i.e. a synthetic rubber-plastic elastomer material, ethylene propylene diene monomer (EPDM). The membrane 18 can also be provided at the lengthwise ends of base plate 2. The base plate 2 could also be made wider and the sides of the base plate could be made to extend down along the sides of ski 8, resulting in increased strength in the base plate 2 and greater snow entry prevention. Also, the side edges of the base plate 2 can be constructed to lie in grooves provided in the ski 8. This arrangement not only helps to prevent the entry of snow but also it can allow lowering of the top surface of the base plate 2 by providing a base plate 2 made of a top plate and longitudinal ribs only, with the ribs recessed into ski 8, such that the top surface of the base plate 2 can rest very close to the stop surface of the ski 8 in the unflexed position.

Figure 6:
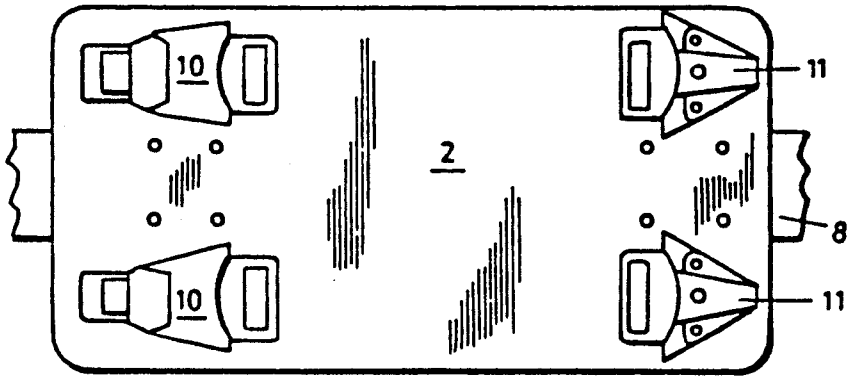
FIG. 6 is a top plan view of the third embodiment of the invention.
Figure 5:
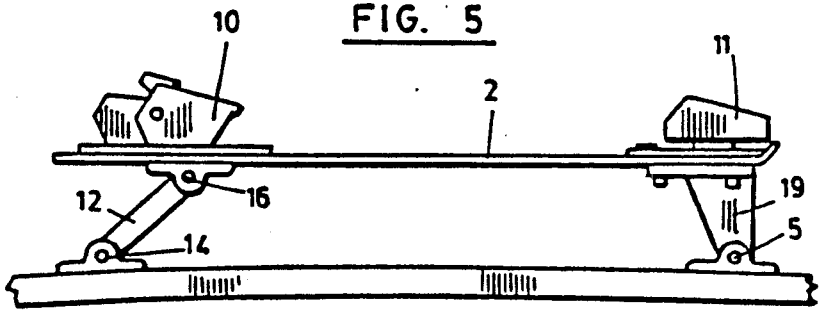
FIG. 5 is a side view of a third embodiment of the invention.

FIGS. 5 and 6 show the third embodiment of the invention in which the base plate is widened and raised to about 8 cm above the ski 8, using a longer link member 12 in the rear and an extended portion 19 at the front. The base plate 2 accepts two sets of bindings 10,11, thus providing a uniski arrangement.

Although the invention has thus been described with reference to the preferred embodiments, it will be appreciated that certain changes and modifications are possible while remaining within the scope of the invention. For example, the fixed attachment means which are shown to be provided at the front may be provided at the rear, while attachment means 6 can be alternatively provided at the front. Base plate 2 is shown as being only somewhat longer than the distance between bindings 10,11. The distance between front pin 5 and rear pin 16 or 15 of base plate 2 may be longer to control further ski chatter, and can also be shorter as desired.

I claim:

1. A ski boot binding mounting for mounting a ski boot binding to a ski, the ski binding mounting comprising:

a base plate for supporting the ski boot binding, said base plate having first and second longitudinal ends;

first attachment means for pivotally fixing the first longitudinal end of the base plate to the ski, said first attachment means allowing the first end to pivot about a first axis transverse to the ski; and second attachment means for pivotally attaching the second longitudinal end of the base plate to the ski, said second attachment means allowing the second end to pivot about a second axis transverse to the ski and allowing movement of the plate in a longitudinal direction of the ski while preventing any lateral movement of the base plate with respect to the ski wherein said second attachment means comprise a link member having a lower rear end and an upper front end, the link member being pivotally connected at said lower rear end to the ski and at said upper front end to the base plate, such that said movement in said lengthwise direction is achieved by pivoting of the link member.

2. Mounting according to claim 1, wherein said first end is forward of said second end.

3. Mounting according to claim 1, wherein the link member makes an angle of at least 30 degrees with respect to the ski.

4. Mounting according to claim 3, wherein a distance between a pivot axis of said lower rear end and said upper front end of the link member is between 1.5 and 5.0 cm.

5. Mounting according to claim 1, wherein the second attachment means comprise a pin and track assembly.

6. Mounting according to claim 1, further comprising seal means for preventing entry of snow between the base plate and the ski.

7. Mounting according to claim 6, wherein the seal means comprise a resilient rubber wall to be connected between the base plate and the ski.

8. Mounting according to claim 5, further comprising seal means for preventing entry of snow between the base plate and the ski.

9. Mounting according to claim 8, wherein the seal means comprise a resilient rubber wall to be connected between the base plate and the ski.

10. Mounting according to claim 1, wherein the base plate is able to support two sets of ski boot bindings to be arranged side by side, whereby the mounting can be used for a uniski arrangement.

11. Mounting according to claim 5, wherein the base plate is able to support two sets of ski boot bindings to be arranged side by side, whereby the mounting can be used for for a uniski arrangement.

* * * * *